US005389272A

United States Patent [19]

Beltzer et al.

[11] Patent Number: 5,389,272

[45] Date of Patent: Feb. 14, 1995

[54] LUBRICATING OIL COMPOSITIONS CONTAINING TRITHIOCYANURIC ACID

[75] Inventors: Morton Beltzer; Jacob J. Habeeb, both of Westfield, N.J.

[73] Assignee: Exxon Research & Engineering Co., Florham Park, N.J.

[21] Appl. No.: 229,885

[22] Filed: Apr. 19, 1994

Related U.S. Application Data

[63] Continuation of Ser. No. 21,508, Feb. 22, 1993, abandoned.

[51] Int. Cl.[6] ..... C10M 133/22

[52] U.S. Cl. ..... 252/47; 252/47.5; 252/565

[58] Field of Search ..... 252/47, 47.5, 565

[56] References Cited

U.S. PATENT DOCUMENTS

| | | | |
|---|---|---|---|
| 2,676,151 | 4/1954 | Loughran et al. | 252/47 |
| 4,045,376 | 8/1977 | Rubin et al. | 252/565 |
| 4,178,253 | 12/1979 | Lee et al. | 252/47 |

*Primary Examiner*—Stephen Kalafut
*Assistant Examiner*—Cephia D. Toomer
*Attorney, Agent, or Firm*—James H. Takemoto

[57] ABSTRACT

The addition of trithiocyanuric acid to a lubricating oil basestock provides a lubricating oil composition showing improved antiwear, friction reducing and/or extreme pressure properties.

6 Claims, 1 Drawing Sheet

LUBRICATING OIL COMPOSITIONS CONTAINING TRITHIOCYANURIC ACID

CROSS REFERENCE TO RELATED APPLICATION

This application is a Rule 60 continuation of U.S. Ser. No. 021,508, filed Feb. 22, 1993, abandoned.

FIELD OF THE INVENTION

This invention relates to a lubricant composition containing trithiocyanuric acid and its use as a multifunctional additive in aviation turbine oils and engine oils for internal combustion engines.

DESCRIPTION OF THE RELATED ART

Jet engines operate under conditions which require that lubricants perform at high temperatures. The temperatures are such that natural lubricating oils are not suitable for use in jet engines. Current original equipment manufacturer and military specifications require that aviation turbine oils meet a number of stringent performance requirements. New jet engines place increased demands on aviation turbine oils, particularly with regard to their load bearing the properties. Many load bearing (extreme pressure) additives have drawbacks when used in aviation turbine oils due to the extreme operating conditions and stringent specifications which such oils must meet.

In order to protect internal combustion engines from wear, engine lubricating oils have been provided with antiwear and antioxidant additives. The primary oil additive for the past 40 years for providing antiwear and antioxidant properties has been zinc dialkyldithiophosphate (ZDDP). Oil formulations containing ZDDP, however, require friction modifiers in order to reduce energy losses in overcoming friction. Such energy losses result in lower fuel economy. Moreover, oil additive packages containing ZDDP have environmental drawbacks. ZDDP adds to engine deposits which can lead to increased oil consumption and emissions. Moreover, ZDDP is not ash-free. Various ashless oil additive packages have been developed recently due to such environmental concerns.

It would be desirable to have a multifunctional lubricating oil additive which provides extreme pressure capabilities in aviation turbine oils which meets jet engine specifications as well as provide friction modifying and antiwear properties in lubricating oils for internal combustion engines.

SUMMARY OF THE INVENTION

This invention relates to a lubricating oil composition which comprises (a) a major amount of a lubricating oil basestock and (b) a minor amount of trithiocyanuric acid. Another embodiment of the invention relates to a lubricating oil composition for jet engines which comprises (a) a major amount of an aviation turbine oil, and (b) a minor amount of trithiocyanuric acid. Yet another embodiment of the invention relates to a lubricating oil composition for use in internal combustion engines which comprises (a) a major amount of a lubricating oil basestock and (b) a minor amount of trithiocyanuric acid. Other embodiments include a method for improving antiwear and friction reducing performance in an internal combustion engine by lubricating the engine with an oil containing trithiocyanuric acid, and a method for improving the extreme pressure performance in jet engines by lubricating the jet engine with an aviation turbine oil containing trithiocyanuric acid.

DETAILED DESCRIPTION OF THE INVENTION

Figure 1:
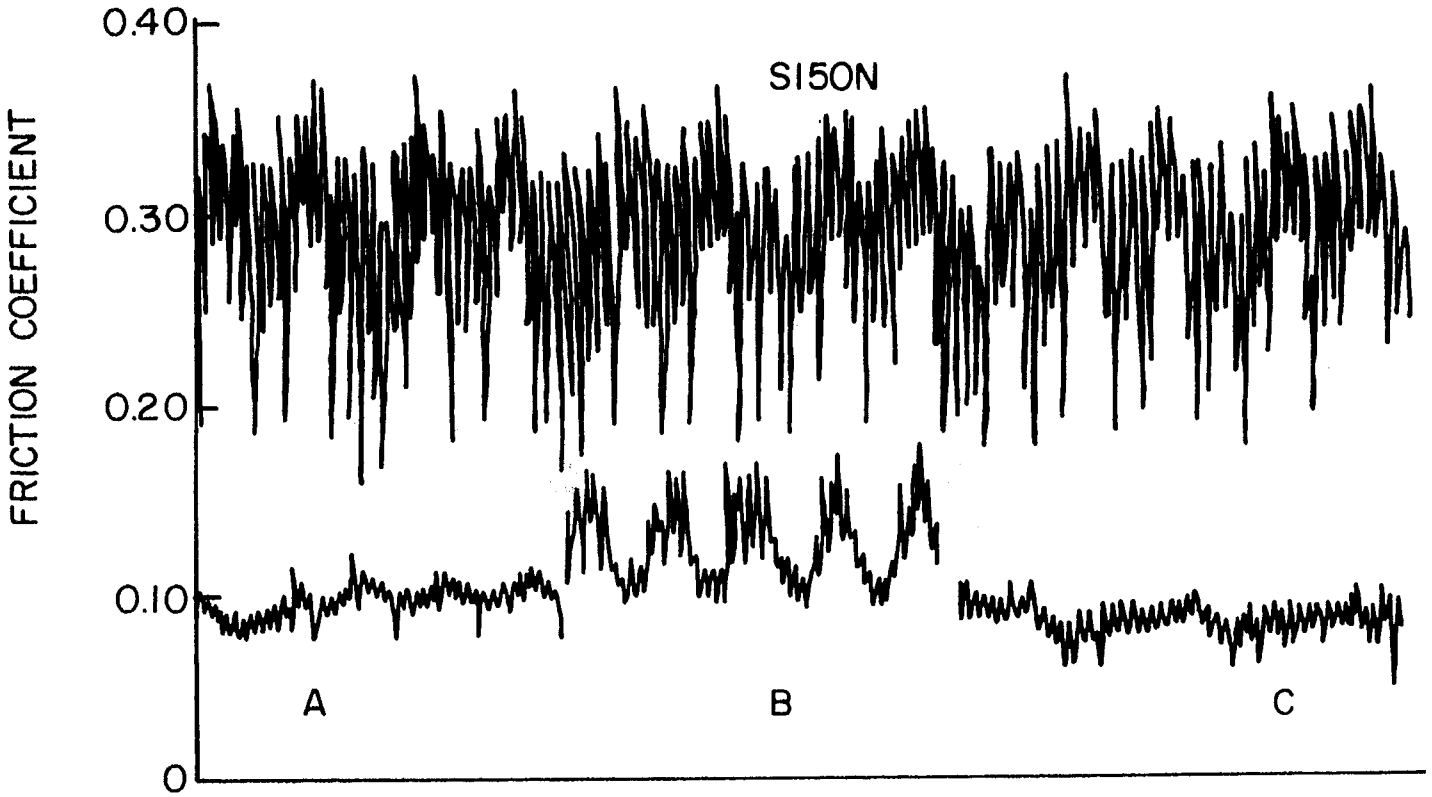
FIG. 1 is a tracing of the friction coefficient resulting from a ball on cylinder friction test on lubricating oils with and without trithiocyanuric acid.

This invention requires a lubricating oil basestock and trithiocyanuric acid. In general, the lubricating oil will comprise a major amount of a lubricating oil basestock (or base oil) and a minor amount of trithiocyanuric acid.

The lubricating oil basestock can be derived from natural lubricating oils, synthetic lubricating oils, or mixtures thereof. In general, the lubricating oil basestock will have a kinematic viscosity ranging from about 5 to about 10,000 cSt at 40° C., although typical applications will require an oil having a viscosity ranging from about 10 to about 1,000 cSt at 40° C.

Natural lubricating oils include animal oils, vegetable oils (e.g., castor oil and lard oil), petroleum oils, mineral oils, and oils derived from coal or shale.

Synthetic oils include hydrocarbon oils and halo-substituted hydrocarbon oils such as polymerized and interpolymerized olefins (e.g. polybutylenes, polypropylenes, propylene-isobutylene copolymers, chlorinated polybutylenes, poly(1-hexenes), poly(1-octenes), poly(1-decenes), etc., and mixtures thereof); alkylbenzenes (e.g. dodecylbenzenes, tetradecylbenzenes, dinonylbenzenes, di(2-ethylhexyl)benzene, etc.); polyphenyls (e.g. biphenyls, terphenyls, alkylated polyphenyls, etc.); alkylated diphenyl ethers, alkylated diphenyl sulfides, as well as their derivatives, analogs, and homologs thereof; and the like.

Synthetic lubricating oils also include alkylene oxide polymers, interpolymers, copolymers and derivatives thereof wherein the terminal hydroxyl groups have been modified by esterification, etherification, etc. This class of synthetic oils is exemplified by polyoxyalkylene polymers prepared by polymerization of ethylene oxide or propylene oxide; the alkyl and aryl ethers of these polyoxyalkylene polymers (e.g., methyl-polyisopropylene glycol ether having an average molecular weight of 1000, diphenyl ether of polyethylene glycol having a molecular weight of 500–1000, diethyl ether of polypropylene glycol having a molecular weight of 1000–1500); and mono- and polycarboxylic esters thereof (e.g., the acetic acid esters, mixed $C_3$–$C_8$ fatty acid esters, and $C_{13}$ oxo acid diester of tetraethylene glycol).

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid, and the like.

Esters useful as synthetic oils also include those made from linear or branched $C_5$ to $C_{12}$ monocarboxylic acids and polyols and polyol ethers such as neopentyl glycol, trimethylolpropane, pentaerythritol, dipentaerythritol, tripentaerythritol, pentaerythritol monoethylether, and the like. This class of synthetic oils is particularly useful as aviation turbine oils. Especially preferred esters for use as aviation turbine oils include the linear or branched $C_5$ to $C_{12}$ monocarboxylic acid esters of trimethylolpropane, pentaerythritol and dipentaerythritol.

Silicon-based oils (such as the polyakyl-, polyaryl-, polyalkoxy-, or polyaryloxy-siloxane oils and silicone oils) comprise another useful class of synthetic lubricating oils. These oils include tetraethyl silicone, tetraisopropyl silicone, tetra-(2-ethylhexyl) silicone, tetra-(4-methyl-2-ethylhexyl) silicone, tetra(p-tert-butylphenyl) silicone, hexa-(4-methyl-2-pentoxy)-disiloxane, poly(-methyl)-siloxanes and poly(methylphenyl) siloxanes, and the like. Other synthetic lubricating oils include liquid esters of phosphorus-containing acids (e.g., tricresyl phosphate, trioctyl phosphate, diethyl ester of decylphosphonic acid), polymeric tetrahydrofurans, polyalphaolefins, and the like.

The lubricating oil may be derived from unrefined, refined, rerefined oils, or mixtures thereof. Unrefined oils are obtained directly from a natural source or synthetic source (e.g., coal, shale, or tar sands bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Rerefined oils are obtained by treating refined oils in processes similar to those used to obtain the refined oils. These rerefined oils are also known as reclaimed or reprocessed oils and often are additionally processed by techniques for removal of spent additives and oil breakdown products.

Trithiocyanuric acid used in the lubricant compositions of this invention may exist in different tautomeric forms represented by formulas I, II or mixtures thereof:

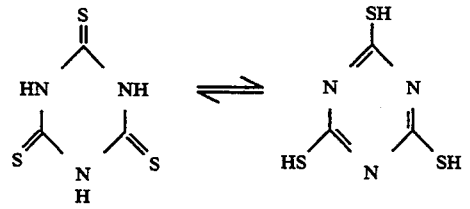

I II

When used as an additive in lubricant compositions, a minor amount of trithiocyanuric acid exhibits multifunctional capabilities such as extreme pressure, friction reducing and antiwear properties. The amount of trithiocyanuric acid need be only the amount necessary to impart extreme pressure, friction reducing and/or antiwear properties to the lubricating oil. In general, this amount will range from about 0.005 to about 2.0 wt. %, preferably about 0.01 to about 0.10 wt. %, most preferably about 0.01 to about 0.05 wt. % based on lubricating oil.

If desired, other additives known in the art may be added to the lubricating oil basestock. Such additives include dispersants, other antiwear agents, antioxidants, rust inhibitors, corrosion inhibitors, detergents, pour point depressants, other extreme pressure additives, viscosity index improvers, other friction modifiers, hydrolytic stabilizers and the like. These additives are typically disclosed, for example, in "Lubricant Additives" by C. V. Smalhear and R. Kennedy Smith, 1967, pp. 1-11 and in U.S. Pat. No. 4,105,571, the disclosures of which are incorporated herein by reference.

Trithiocyanuric acid is prepared by methods well known in the art. These methods involve the treatment of cyanuric chloride with sulfur nucleophiles according to the following reaction scheme:

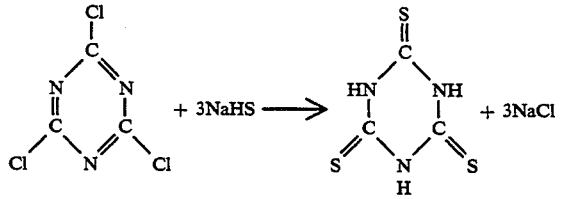

Other sulfur nucleophiles which may be employed in the above reaction scheme include sodium sulfide, thiourea and thioacetic acid. Trithiocyanuric acid is also available commercially from, e.g., Degussa Corporation, New Jersey.

A lubricating oil containing trithiocyanuric acid can be used in essentially any application where wear protection, extreme pressure activity and/or friction reduction is required. Thus, as used herein, "lubricating oil" (or "lubricating oil composition") is meant to include aviation lubricants, automotive lubricating oils, industrial oils, gear oils, transmission oils, and the like. In addition, the lubricating oil composition of this invention can be used in the lubrication system of essentially any internal combustion engine, including automobile and truck engines, two-cycle engines, aviation piston engines, marine and railroad engines, and the like. Also contemplated are lubricating oils for gas-fired engines, alcohol (e.g. methanol) powered engines, stationary powered engines, turbines, and the like. Of particular interest is the use of trithiocyanuric acid as an extreme pressure agent in aviation turbine oils for jet engines.

This invention may be further understood by reference to the following examples, which include a preferred embodiment of this invention.

EXAMPLE 1

This example demonstrates the significant load carrying (extreme pressure) capacity of trithiocyanuric acid in aviation turbine oils using the initial seizure load (ISL) test and the Forschungstelle Zahnrader Getriebe (FZG) test.

The initial seizure load is the load at which there is a rapid increase in wear as measured by the wear scar diameter determined by a Four Ball Test. The Four Ball tester used in this work is described in "Standard Handbook of Lubrication Engineering" Section 27, page 4, J. J. O'Connor, Editor in Chief, McGraw-Hill Book Company (1968). In this test, three balls are fixed in a lubricating cup and an upper rotating ball is pressed against the lower three balls. The test balls utilized were made of AISI 52100 steel with a hardness of 65 Rockwell C (840 Vickers) and a centerline roughness of 25 nm. Prior to the tests, the test cup, steel balls, and all holders were washed with 1,1,1 trichloroethane. The steel balls subsequently were washed with a laboratory detergent to remove any solvent residue, rinsed with water, and dried under nitrogen. The tests lubricant covers the stationary three balls.

The seizure load tests are performed at room temperature at 1500 RPM for a one minute duration at a given load. After each test, the balls are washed and the wear scar diameter (WSD) on the lower balls measured using an optical microscope. The load at which the wear scar equals or exceeds one millimeter is the initial seizure load (ISL).

The FZG Test is a measure of extreme pressure properties in accordance with DIN 51354. In this test, gear wheels run in the lubricant under investigation in a dip lubrication system at a constant speed and a fixed initial oil temperature. The load on the tooth flanks is increased in stages from 1 to 12. The change in the tooth flanks is recorded at the end of each load stage by description, roughness measurement, or contrast impressions. The effectiveness of the lubricant oil is determined by the load at which the total sum of the width of all the damaged areas exceed one gear tooth width. This load stage is known as the failure load stage (FLS). The higher the FLS, the more effective the lubricant oil tested.

The results of the four-ball ISL and FZG tests with trithiocyanuric acid (TTCU) in a commercial aviation turbine oil without load carrying capacity. The results are shown in the following table.

TABLE 1

| Tests | Weight Percents TTCU | | | |
|---|---|---|---|---|
| | 0 | 0.025 | 0.030 | 0.100 |
| 4-Ball ISL, Kg | 72.5 | 87.5 | 87.5 | 92.5 |
| Severe FZG (FLS)[1] | 4–5 | 8 | 8 | 9 |

[1]FZG Test conditions: 140° C. oil temperature, 3000 RPM, 15 minutes per load stage These results, especially the severe FZG, show that TTCU has significant load carrying capability, especially considering the different conditions on the standard FZG test, 90° temperature at the start of the test and a pinion gear rotational speed of 2170 RPM. This significance can be further brought out by examination of the FZG load test corresponding physical parameters corresponding to each load stage as shown in Table 2.

TABLE 2

| Load Stage Number | Torque on Pinion (Newton Meters) | Tooth Normal Force (Newtons) | Hertz Load in Pitch Point (Newtons/mm$^2$) | Total Work Transmitted by Test Gears at FLS (kWh) |
|---|---|---|---|---|
| 1 | 3.3 | 99.0 | 146 | 0.19 |
| 2 | 13.7 | 407.0 | 295 | 0.97 |
| 3 | 35.3 | 1044 | 474 | 2.96 |
| 4 | 60.8 | 1800 | 621 | 6.43 |
| 5 | 94.1 | 2786 | 773 | 11.8 |
| 6 | 135.3 | 4007 | 927 | 19.5 |
| 7 | 183.4 | 5435 | 1080 | 29.9 |
| 8 | 239.3 | 7080 | 1232 | 43.5 |
| 9 | 302.0 | 8949 | 1386 | 60.8 |
| 10 | 372.6 | 11029 | 1538 | 82.0 |
| 11 | 450.1 | 13342 | 1691 | 107.7 |
| 12 | 534.5 | 15826 | 1841 | 138.1 |

Current aviation turbine oils are generally not high load oils. On FZG tests, these oils typically have an FLS of 4 or 5, similar to that exhibited by the test oil cited in Table 1 above. Using the above table, the differences between a low load oil, FLS=4 or 5 and a high load oil, FLS=8 can be best understood by assessing the torque, force, load and total work ratios between a high load oil and low load capability oils. These ratios are shown below in Table 3.

TABLE 3

| Load Stage Ratios | Corresponding Ratios of Indicated Physical Parameters | | | |
|---|---|---|---|---|
| | Torque | Force | Load | Total Work |
| 8/4 | 3.96 | 3.93 | 1.98 | 6.77 |
| 8/5 | 2.54 | 2.54 | 1.59 | 3.69 |

It is apparent from Table 3 how effective a load additive is in increasing significantly gear performance capabilities before extensive gear damage is incurred.

EXAMPLE 2

This example is directed to a showing of the copper corrosion properties of TTCU. Although many sulfur-containing additives such as dimercaptothiadiazoles provide high load, these additives are also corrosive, especially with respect to copper. A distinct advantage of TTCU is that despite its high sulfur content, the linkage between high load capability and copper corrosion is considerably reduced as demonstrated in OCS (oxidation, corrosion, and stability) tests. The OCS tests were conducted at 400° F. for 72 hours in the presence of oxygen and measure oil degradation, increase in acidity (change in total acid number, Δ TAN) and increase in viscosity, as well as corrosion of copper, silver, magnesium, aluminum and iron.

The results of the OCS test for an oil containing 0.1 wt % tolyltriazole as the copper corrosion inhibitor with different TTCU concentrations is shown below.

TABLE 4

| OCS Test Parameter[1] | Test Result at Indicated Wt % TTCU | | | Test Specifications |
|---|---|---|---|---|
| | 0.025 | 0.03 | 0.05 | |
| Δ % viscosity | 17.12 | 17.74 | 19.46 | <25 |
| Δ TAN (mg KOH/g) | 0.41 | 0.32 | 0.54 | <3 |

TABLE 4-continued

| OCS Test Parameter[1] | Test Result at Indicated Wt % TTCU 0.025 | 0.03 | 0.05 | Test Specifications |
|---|---|---|---|---|
| Sludge (mg/100 cc) | 4.8 | 6.10 | 5.5 | <50 |
| Δ Cu (mg/sq cm) | −0.209 | −0.364 | −0.597 | <0.4 |
| Δ Ag (mg/sq cm) | 0.0 | 0.0 | −0.016 | <0.2 |
| Δ Mg, Al, Fe (mg/sq cm) | 0.049 | 0.024 | −0.024 | <0.2 |

[1]In a commerical aviation turbine oil.

The test specifications were met at the three concentrations of TTCU except for the single instance of copper at 0.05 wt. % TTCU. By way of comparison, a dimercaptothiadiazole at a concentration of 0.03 wt. % results in an OCS copper loss of 2.23 mg/sq cm which is six times the loss exhibited by TTCU with the present corrosion inhibitor, tolyltriazole.

The use of a more effective copper corrosion inhibitor than tolyltriazole, carboxybenzotriazole (CBT) is shown below in Table 5.

TABLE 5

| OCS Test Parameter | Test Results with 0.03 wt. % TTCU and 0.1 wt % CBT |
|---|---|
| Δ % viscosity | 15.6 |
| Δ TAN (mg KOH/g) | −0.09 |
| Sludge (mg/100 cc) | 3.6 |
| Δ Cu (mg/sq cm) | −0.202 |
| Δ Ag (mg/sq cm) | 0.0 |
| Δ Mg, Al, Fe (mg/sq cm) | 0.0 |

The use of CBT results in a 45% decrease in copper corrosion in a turbine oil containing 0.03 wt. % TTCU oil compared to the oil containing the same TTCU concentration but with 0.1% tolyltriazole.

EXAMPLE 3

The load carrying extreme pressure properties of trithiocyomuric acid were further evaluated in this example by using the Ryder gear machine described in ASTM method D- 1947. Briefly, this test subjects a set of gears lubricated by the test oil to a series of load increments under controlled conditions. The amount of tooth-face scuffing occurring at each load is measured. The percentage of tooth-face scuffing is plotted against the load to determine the load-carrying ability of the test oil. The load-carrying ability of the oil is defined as the tooth load, in pounds per inch of gear tooth, at which an average tooth-face scuffing at 22.5% of the tooth area has been reached. The results are shown in Table 6.

TABLE 6

| ppm TTCU | Ryder Gear Results lbs/in | % of Reference[1] |
|---|---|---|
| 0 | 2530 | 102.8 |
| 100 | 3000 | 121.8 |
| 200 | 2925 | 117.9 |
| 300 | 2944 | 118.7 |

[1]Reference oil is Hercolube A, a polyester fluid marketed by Hercules, Inc.

An oil with enhanced load capability is considered to be one with a minimum of 107% of the reference oil (2460 lbs/in). As shown in Table 6, this minimum value is easily exceeded by 100 ppm of TTCU in the oil.

EXAMPLE 4

Trithiocyanuric acid also has antiwear properties as shown in this example, and can be used as a replacement for zinc dialkyldithiophosphate (ZDDP) which is a standard antiwear agent in passenger car engine oils. The Four Ball wear test is described in detail in ASTM method D-2266. In this test, three balls are fixed in a lubricating cup and an upper rotating ball pressed against the lower three balls. The test balls were made of AISI 52100 steel with a hardness of 65 Rockwell C (840 Vickers) and a centerline roughness of 25 nm.

The Four Ball wear tests were performed at 100° C., 60 Kg load, and 1200 RPM for 45 minutes duration, after which the wear scar diameter (WSD) on the lower balls were measures using an optical microscope. Using the WSDs, the wear volume (WV) was calculated from standard equations (Wear Control Handbook, edited by M. B. Peterson and W. O. Weiner, p. 451, American Society of Mechanical Engineers (1980)). The percent wear reduction (% WR) for each oil tested was then calculated from the following formula:

$$\% WR = \left[1 - \frac{WV \text{ with additive}}{WV \text{ without additive}}\right] \times 100$$

The results of these tests with a commercially available passenger car oil which did not contain ZDDP are shown below.

TABLE 7

| % TTCU in ZDDP Free Oil | 4-Ball WSD (mm) | WV ($mm^3 \times 10^4$) | % WR |
|---|---|---|---|
| 0 | 1.6 | 506 | 0.0 |
| 0.05 | 0.70 | 18 | 96.4 |
| 0.08 | 0.66 | 14 | 97.2 |
| 0.10 | 0.70 | 18 | 96.4 |
| 0.20 | 0.80 | 31 | 93.9 |

The % WR with the fully formulated oil containing 1.1% ZDDP was 97.0%. These results show that TTCU can readily supplant ZDDP in passenger car engine oils.

EXAMPLE 5

Trithiocyanuric acid is also an effective friction modifier as shown in this example. The Ball on Cylinder (BOC) friction tests were performed using the experimental procedure described by S. Jahanmir and M. Beltzer in ASLE Transactions, Vol. 29, No. 3, p. 425 (1985) using a force of 0.8 Newtons (1 Kg) applied to a 12.5 mm steel ball in contact with a rotating steel cylinder that has a 43.9 mm diameter. The cylinder rotates inside a cup containing a sufficient quantity of lubricating oil to cover 2 mm of the bottom of the cylinder. The cylinder was rotated at 0.25 RPM. The friction force was continuously monitored by means of a load transducer. In the tests conducted, friction coefficients attained steady state values after 7 to 10 turns of the cylinder. Friction experiments were conducted with an oil temperature of 100° C. The friction coefficient (FC) time traces are shown in FIG. 1 which show traces for the following oils, S150N, a formulated engine oil without the friction modifier, and the same formulated oil containing 0.1 wt % TTCU.

S150N is a solvent extracted, dewaxed, hydrofined neutral basestock having a viscosity of 32 centistokes at 40° C. The friction trace with S150N is shown in FIG. 1 for comparison purposes to demonstrate that a formulated oil even without a friction modifying additive will have a significantly lower friction coefficient due to additives not specifically designed to lower friction.

The FC of 0.31 for S150N represents an average of the high and low excursions of the FC with time. These excursions are due to the phenomenon of "stick slip," the transition from static friction (high FC) to kinetic friction (low FC). Trace A in FIG. 1 is for a fully formulated passenger engine oil containing a friction modifier and shows an FC of about 0.10. Trace B is for the same passenger oil without the friction modifier, and the FC rises to an average value of 0.12. Trace C is the passenger oil without the friction modifier but with 0.1 wt. % TTCU. The average value for FC drops to 0.08 indicating the improved friction modifying properties of TTCU.

What is claimed is:

1. A method for improving the extreme pressure performance of lubricants used in jet engines which comprises lubricating the jet engine with a lubricating oil composition which comprises:

(a) a major amount of an aviation turbine oil, and (b) a minor amount of trithiocyanuric acid.

2. The method of claim 1 wherein the aviation turbine oil is a linear or branched $C_5$ to $C_{12}$ monocarboxylic acid ester of trimethylolpropane, pentaerythritol and dipentaerythritol.

3. The method of claim 1 additionally comprising at least one antioxidant, metal passivator, corrosion inhibitor and hydrolytic stabilizer.

4. The method of claim 1 wherein the amount of trithiocyanuric acid is from about 0.005 to about 2.0 wt. %, based on oil.

5. A method for improving the antiwear and friction-reducing performance of lubricants used in internal combustion engines which comprises lubricating the engine with a lubricating oil composition which comprises:

(a) a major amount of a lubricating oil basestock, and (b) a minor amount of trithiocyanuric acid.

6. The method of claim 5 wherein the amount of trithiocyanuric acid is from about 0.005 to about 2.0 wt. %, based on oil.

* * * * *